US010649400B2

(12) United States Patent
Tanaka et al.

(10) Patent No.: US 10,649,400 B2
(45) Date of Patent: May 12, 2020

(54) IMAGE FORMING APPARATUS WITH FEATURES THAT SUPPRESS DEFORMATION OF DOOR CAUSED BY COUNTERFORCE FROM CARTRIDGE

(71) Applicant: CANON KABUSHIKI KAISHA, Tokyo (JP)

(72) Inventors: Masaki Tanaka, Kawasaki (JP); Shunsuke Hijikata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/162,095

(22) Filed: Oct. 16, 2018

(65) Prior Publication Data

US 2019/0129357 A1 May 2, 2019

(30) Foreign Application Priority Data

Oct. 30, 2017 (JP) ..... 2017-209486

(51) Int. Cl.
*G03G 21/18* (2006.01)
*G03G 21/16* (2006.01)

(52) U.S. Cl.
CPC ..... *G03G 21/1842* (2013.01); *G03G 21/1633* (2013.01); *G03G 21/1647* (2013.01); *G03G 2221/1846* (2013.01)

(58) Field of Classification Search
CPC ..... G03G 21/1842; G03G 21/1633; G03G 21/1647
See application file for complete search history.

(56) References Cited

U.S. PATENT DOCUMENTS 5,787,323 A * 7/1998 Nomura ..... G03G 21/1853 399/111

FOREIGN PATENT DOCUMENTS

| | | | |
|---|---|---|---|
| JP | 2001066967 | A | 3/2001 |
| JP | 2011227457 | A | 11/2011 |
| JP | 2015125289 | A | 7/2015 |
| JP | 2015141407 | A | 8/2015 |
| JP | 5773675 | B2 | 9/2015 |

* cited by examiner

*Primary Examiner* — David M. Gray
*Assistant Examiner* — Andrew V Do
(74) *Attorney, Agent, or Firm* — Canon U.S.A., Inc. IP Division

(57) ABSTRACT

An image forming apparatus including a cartridge including an image carrying member and a positioning portion, and an apparatus main body. The apparatus main body including an opening portion, a rotatable opening and closing member, the opening and closing member including an engaging portion and being rotatable between a first position and a second position, an engaged portion, an abutment portion that determines a position of the attached cartridge, and a pressing portion applying pressing force to the cartridge. The opening and closing member rotates from the first position to the second position against counterforce of the pressing force, and the engaging portion is provided in an area of the opening and closing member that is closer to the rotational axis than an area of the opening and closing member that receives the counterforce.

20 Claims, 9 Drawing Sheets

IMAGE FORMING APPARATUS WITH FEATURES THAT SUPPRESS DEFORMATION OF DOOR CAUSED BY COUNTERFORCE FROM CARTRIDGE

BACKGROUND OF THE INVENTION

Field of the Invention

The present disclosure relates to an image forming apparatus, such as a laser beam printer or an LED printer, that forms an image on a recording material using an electrophotographic method.

Description of the Related Art

Laser beam printers include an image forming apparatus main body (hereinafter, referred to as an apparatus main body), and a process cartridge (hereinafter, referred to as a cartridge) including a photosensitive drum (hereinafter, referred to as a drum). There are cartridges that are configured to be detachably attachable to the apparatus main body.

Incidentally, in a state in which such a detachably attachable cartridge is attached to the apparatus main body, the cartridge needs to be pressed against a transfer member provided in the apparatus main body. As disclosed in Japanese Patent No. 5773675, there is known a configuration in which a pressing member that presses a cartridge is provided in a door for inserting and removing the cartridge.

However, there are issues in the above configuration in that since the user presses the cartridge through the door, the door becomes deformed depending on the position where the user presses the door and the door becomes difficult to close or is not totally closed.

SUMMARY OF THE INVENTION

A first aspect of the present disclosure is an image forming apparatus including a cartridge including an image carrying member that carries a toner image, and a positioning portion; and an apparatus main body to which the cartridge can be detachably attached in an intersecting direction intersecting a longitudinal direction of the image carrying member. The apparatus main body includes an opening portion through which the cartridge passes when being attached to the apparatus main body, an opening and closing member that is rotatable about a rotational axis extending in the longitudinal direction of the image carrying member, the opening and closing member being rotatable between a first position where the opening and closing member open the opening portion and a second position where the opening and closing member close the opening portion, the opening and closing member including an engaging portion, an engaged portion that is configured not to become engaged with the engaging portion when the opening and closing member is at the first position and that is configured to engage with the engaging portion while the opening and closing member moves from the first position to the second position, an abutment portion that, by abutting against the positioning portion of the cartridge, determines a position of the cartridge with respect to the apparatus main body in the intersecting direction of the cartridge when the cartridge is attached to the apparatus main body, and a pressing portion that applies pressing force to the cartridge in a direction abutting the positioning portion of the cartridge against the abutment portion. In the image forming apparatus, the opening and closing member is configured to rotate from the first position to the second position against counterforce of the pressing force, and when viewed in a rotational axis direction, the engaging portion is provided in an area of the opening and closing member that is closer to the rotational axis than an area of the opening and closing member that receives the counterforce.

Further features of the present invention will become apparent from the following description of exemplary embodiments with reference to the attached drawings.

DESCRIPTION OF THE EMBODIMENTS

First Exemplary Embodiment

Hereinafter, exemplary embodiments of the present disclosure will be described in detail with reference to the drawings. Note that the rotational axis direction of the drum is the longitudinal direction. Furthermore, in the longitudinal direction, a side on which the drum receives driving force from an apparatus main body is referred to as a drive side, and a side opposite to the drive side is referred to as a non-drive side.

Figure 1:
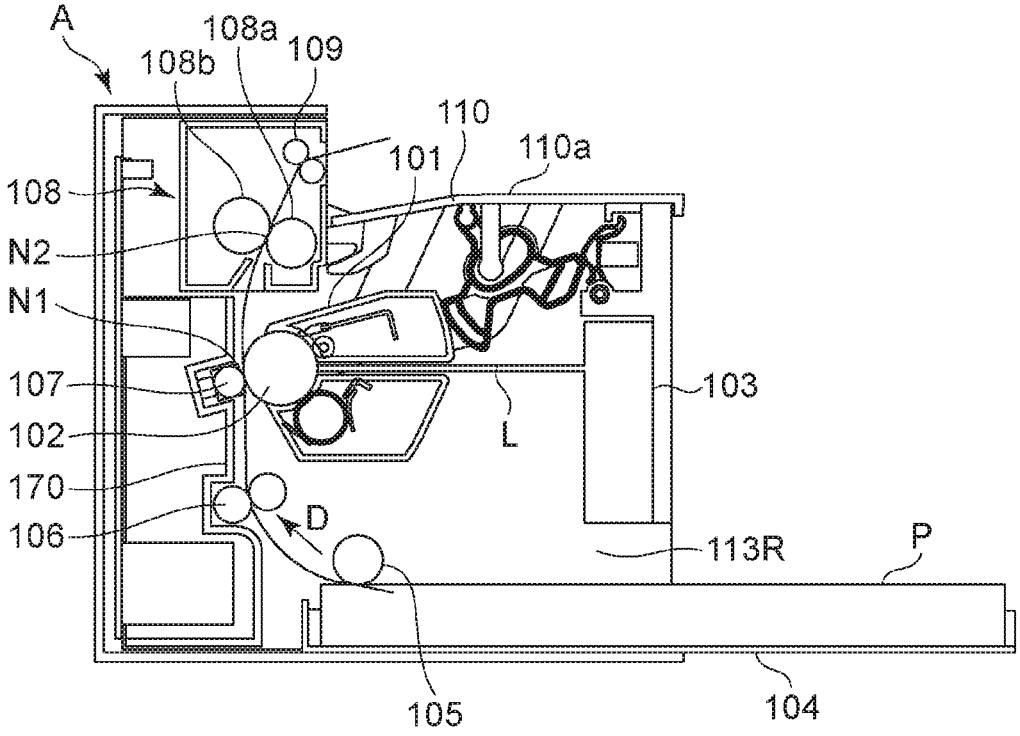
FIG. 1 is a cross-sectional view of an image forming apparatus according to a first exemplary embodiment.

Referring to FIG. 1, an overall configuration and an image forming process will be described.

FIG. 1 is a cross-sectional view of an apparatus main body A of an electrophotographic image forming apparatus that is an exemplary embodiment of the present disclosure. Note that the apparatus main body A is the portion of the electrophotographic image forming apparatus excluding a cartridge 101.

Overall Configuration of Image Forming Apparatus

The electrophotographic image forming apparatus illustrated in FIG. 1 is a laser beam printer employing an electrophotographic technology and is a laser beam printer in which the cartridge 101 is detachably attachable from the main body A of the apparatus. An overall configuration of the electrophotographic image forming apparatus will be briefly described first.

An exposure device 103 that forms a latent image on a drum 102 serving as an image carrying member of the cartridge 101 is disposed in the apparatus main body A. Furthermore, a feed tray 104 containing recording materials P that are subject of image formation is disposed below the cartridge 101. Furthermore, the apparatus main body A is provided with the following members along a conveyance direction D of the recording material P. A feed roller 105, a pair of conveyance rollers 106, a conveyance frame 170, a transfer roller 107, a fixing unit 108, a pair of discharge rollers 109, a door 110 that includes a discharged sheet stacking surface 110*a* and that is an opening and closing member that can expose or close an opening through which the cartridge 101 are attached to or detached from the apparatus main body A. The door 110 rotates about a rotational axis extending in the longitudinal direction of the drum 102. Note that the fixing unit 108 includes a heat roller and a pressure roller. Furthermore, the cartridge 101 is supported by the apparatus main body A and the supporting configuration will be described in detail later.

Configuration of Cartridge

Figure 2:
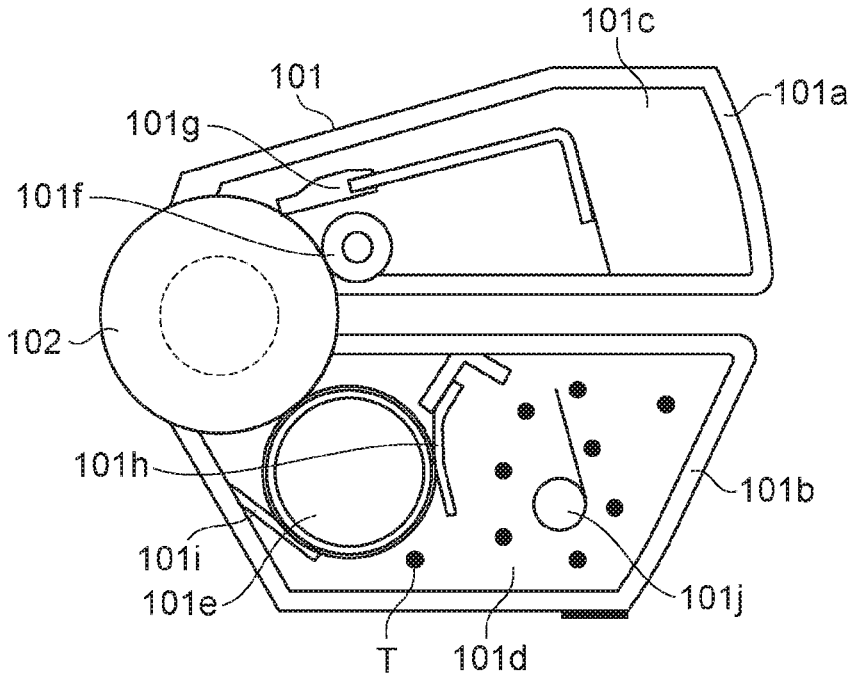
FIG. 2 is a cross-sectional view of a cartridge according to the first exemplary embodiment.

FIG. 2 illustrates a cross-sectional view of the cartridge 101. The cartridge 101 mainly includes a cleaner case 101*a* (a first unit, hereinafter denoted as a C-container 101*a*) and a developer case 101*b* (a second unit, hereinafter denoted as a D-container 101*b*). A waste toner chamber 101*c* is formed in the C-container 101*a*. The C-container 101*a* holds the drum 102 (an image carrying member), a charge roller 101*f*, a cleaning blade 101*g* (hereinafter, referred to as a CL-blade 101*g*). A toner chamber 101*d* filled with toner T is formed in the D-container 101*b*. The D-container 101*b* holds a development roller 101*e*, a developing blade 101*h*, a blow-out prevention sheet 101*i*, and a conveyance member 101*j*.

Image Forming Process

Referring next to FIGS. 1 and 2, an outline of the image forming process will be described. First, a motor 117 rotates based on a print start signal sent form the signal board 99, and the drum 102 is rotationally driven at a predetermined circumferential velocity (a processing speed). A charge roller 101*f*, to which a bias voltage has been applied, comes in contact with an outer peripheral surface of the drum 102 and evenly and uniformly charges the outer peripheral surface of the drum 102. The exposure device outputs a laser beam L according to image information. The laser beam L scans and exposes the outer peripheral surface of the drum 102. With the above, an electrostatic latent image according to the image information is formed on the outer peripheral surface of the drum 102.

Meanwhile, in the D-container 101*b*, the toner T inside the toner chamber 101*d* is mixed and conveyed by the rotation of the conveyance member 101*j*, and is carried on the surface of the development roller 101*e*. While the toner is triboelectrically charged by the developing blade 101*h*, the layer thickness of the toner T on a peripheral surface the development roller 101*e* serving as a developer carrying member is restricted. The toner T is supplied to the drum 102, is developed on the drum 102 according to the electrostatic latent image, and is tuned into a visible image, that is, a toner image.

Furthermore, synchronizing with the timing at which the laser beam L is output, the recording material P contained at the lower portion of the apparatus main body A is sent out from the feed tray 104 with the feed roller 105 and a pair of conveyance rollers 106. Subsequently, the recording material P is conveyed along the conveyance frame 170 and to a transfer nip N1 between the drum 102 and the transfer roller 107. The toner image is sequentially transferred to the recording material P from the drum 102 at the transfer nip N1.

The recording material P on which the toner image has been transferred is separated from the drum 102 and is conveyed to the fixing unit 108. Subsequently, the recording material P passes through a fixing nip N2 between the heat roller and the pressure roller constituting the fixing device. By being compressed and heated, that is, by going through a fixing process, at the fixing nip N2, the toner image is fixed to the recording material P. The recording material P that has gone through the toner image fixing process is conveyed to the pair of discharge rollers 109 and is discharged onto the discharged sheet stacking surface 110*a*.

Meanwhile, the residual toner T on the outer peripheral surface of the drum 102 after the transferring is removed by the CL-blade 101*g*, and the drum 102 is used in the image forming process once again. The Toner T that has been removed from the drum 102 is stored in the waste toner chamber 101*c* of the C-container 101*a*.

In the above description, the charge roller 101*f*, the development roller 101*e*, the transfer roller 107, and the CL-blade 101*g* are process members that act on the drum 102. Insertion and removal of cartridge, positioning of cartridge, and press holding cartridge Insertion and removal of the cartridge, positioning of the cartridge, and press holding of the cartridge with respect to the apparatus main body A will be described specifically next.

When the user continues printing, the toner T in the cartridge 101 is consumed and ultimately there will be no toner T left in the cartridge 101. In such a case, since printing is not possible, the user needs to replace the cartridge 101. In so doing, the user opens the door 110, removes the cartridge 101 in which there is no toner T through an opening portion 600 formed by the opening operation, inserts a new cartridge 101, and closes the door 110; accordingly, printing can be performed once more. The cartridge 101 is moved in a direction intersecting a longitudinal direction of the drum 102 to mount the cartridge 101 in the apparatus main body A through an opening 600. When the cartridge 101 is mounted in the apparatus main body A, the cartridge 101 passes through the opening 600.

Figure 3:
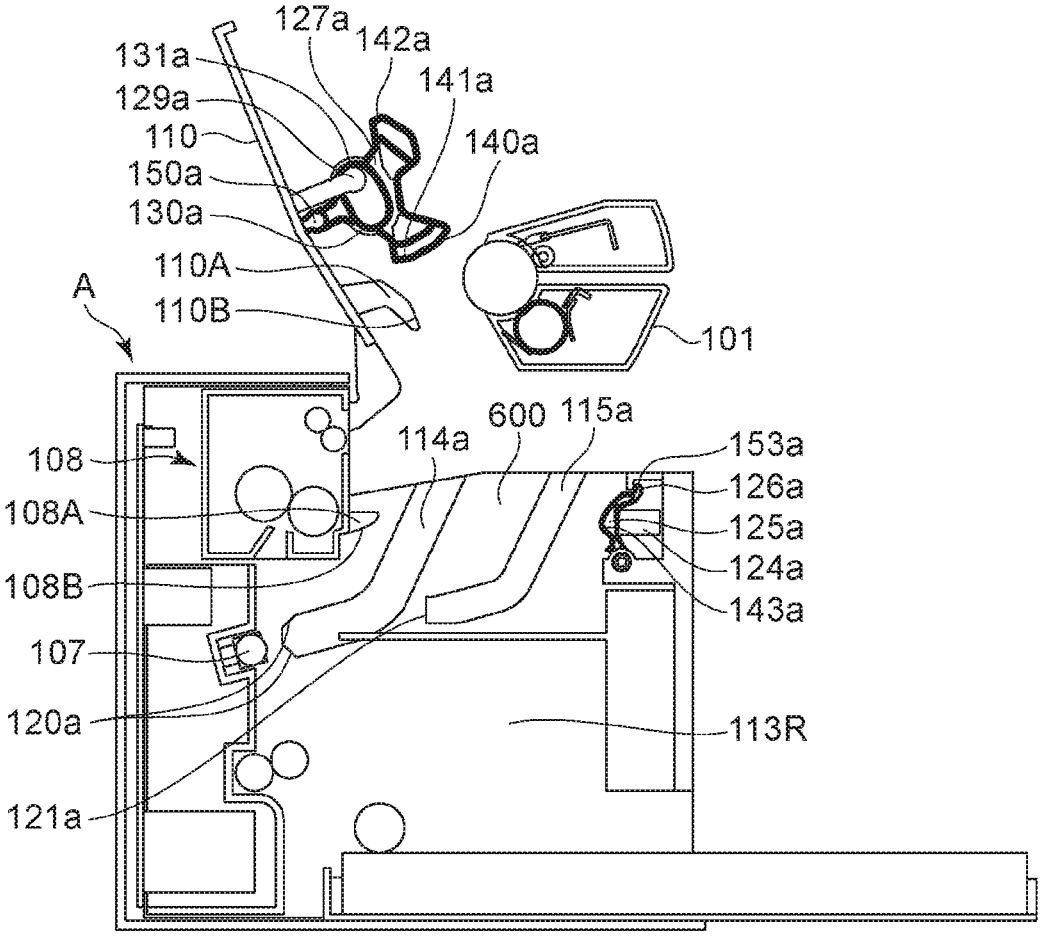
FIG. 3 is a cross-sectional view of an apparatus main body according to the first exemplary embodiment.

As illustrated in FIG. 3, cartridge guides 114*a* and 115*a* serving as insertion and removal guides of the cartridge 101 are provided in a side plate 113R of the apparatus main body A. Similar to the side plate 113R side, cartridge guides 114*b* and 115*b* serving as insertion and removal guides of the cartridge 101 are provided in a side plate 112L (not shown). Furthermore, cartridge guides 114*a* and 114*b* include cartridge abutment portions (abutment portions) 120*a* and 120*b*, respectively, that position the cartridge 101 to a position (hereinafter, denoted as a mount position) allowing an image to be formed. Furthermore, the cartridge guides 115*a* and 115*b* include cartridge restriction portions 121*a* and 121*b* (not shown) that are restriction portions that restrict the rotation of the cartridge.

Figure 4A:
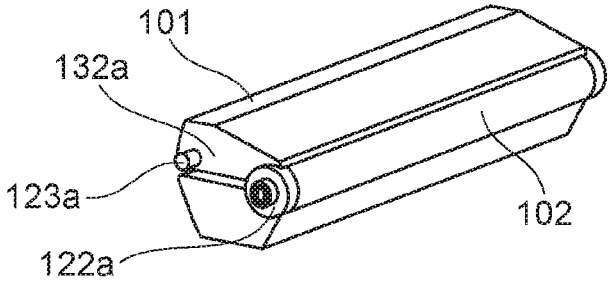
FIGS. 4A to 4C are perspective views of the cartridge according to the first exemplary embodiment.
Figure 4B:
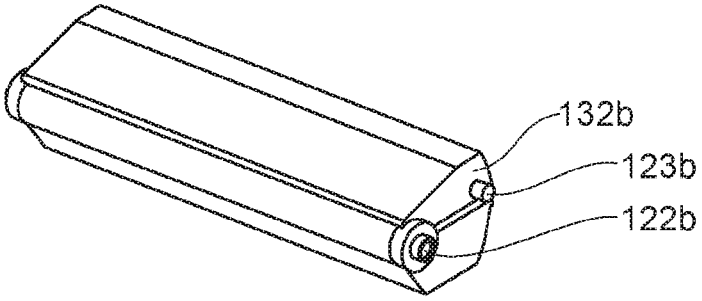
Figure 4C:
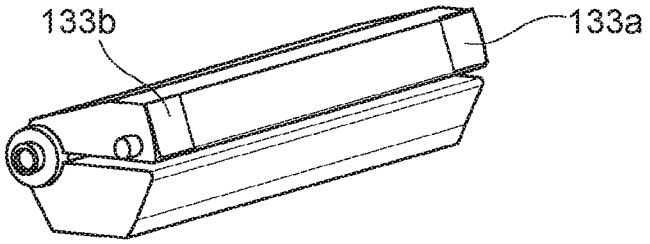

Furthermore, as illustrated in FIGS. 4A to 4C, in the cartridge 101, positioning portion 122*a* and 122*b* that position the drum at a position allowing an image to be formed by coming in contact with the abutment portions 120*a* and 120*b* (not shown) of the apparatus main body A are provided at both ends of the drum in the axial direction. Furthermore, the cartridge 101 further includes rotation stopper portions 123*a* and 123*b* that restrict the rotation of the cartridge 101 by coming in contact with the cartridge restriction portions 121*a* and 121*b* (not shown) of the apparatus main body A.

A pressing spring 124*a* that is an elastic member serving as a pressing portion that presses the cartridge 101 and a pressing lever 125*a* that is pivotably held by the apparatus main body A and that is in contact with the pressing spring 124*a* are disposed on the drive side of the apparatus main body A. In the direction intersecting the longitudinal direction of the drum 102, the pressing portion is provided opposite to the cartridge abutment portion 120*a* across the cartridge 101 mounted in the apparatus main body A in between.

The pressing lever 125*a* includes a temporarily holding portion 126*a*, and the apparatus main body A includes a temporarily held portion 153*a*. When there is no cartridge 101 in the apparatus main body A, the temporarily holding portion 126*a* is in contact with the temporarily held portion 153*a*, and the pressure of the pressing spring 124*a* is held by the apparatus main body A. The non-drive side has a configuration similar to that of the drive side.

Furthermore, door rotating shafts 152*a* and 152*b* of the door 110 are pivotably held by the bearings 151*a* and 151*b* of the apparatus main body A, and the user can open and close the door 110 about a rotation center (a rotational axis) of the door rotating shafts 152*a* and 152*b*. Furthermore, intermediate members 127*a* and 127*b* (sandwiched members) are attached to the door 110 so as to arrange in a rotational axis of the door rotating shafts 152*a*. The intermediate member 152*b* has the same structure as the intermediate member 152*a*. With pivotable fulcrum shaft 128*a* disposed in the door 110, the intermediate member 127*a* is pivotable about rotation center 150*a* of the intermediate member 127*a*. Furthermore, rotation restricting boss 129*a* is disposed in the door 110.

Restriction surfaces (restriction portions) 130*a*, 130*b*, 131*a*, and 131*b* that restrict rotation are formed in the intermediate members 127*a* and 127*b*. The intermediate member 127*a* is held so as to be pivotable within the area contacting the restriction surface 130*a* and 131*a*, and the intermediate member 127*b* is held rotatable within the area contacting the restriction surface 130*b* and 131*b*. In a state illustrated in FIG. 3 in which the door 110 is open, the rotation restricting boss 129*a* is in contact and is held by the restriction surface 131*a*, and the rotation restricting boss 129*b* is in contact and is held by the restriction surface 131*b*.

Figure 5:
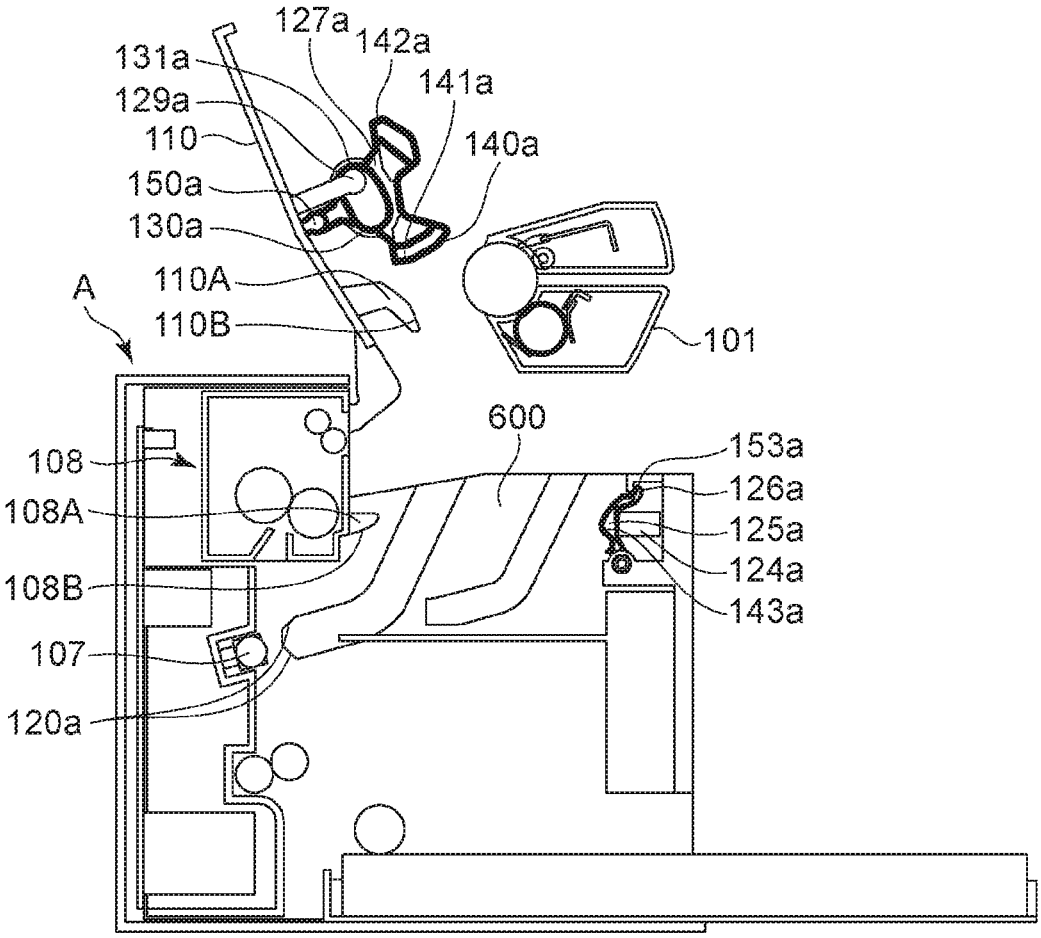
FIG. 5 is a cross-sectional view of the apparatus main body in a case in which a door is at an open position and a cartridge is in the course of being attached to the apparatus main body, according to the first exemplary embodiment.

Referring next to FIG. 5, a description of the insertion of the cartridge 101 through the opening portion 600 formed after the user had opened the door 110 will be given. Note that only the configuration on the drive side will be described; however, the configuration and the operation on the non-drive side are similar to those on the drive side unless described in particular.

After rotating the operating panel 110, with respect to the apparatus main body A, about the center of a rotating shaft 152 from the closed position to the open position, the user inserts the cartridge 101 into the apparatus main body A. When the cartridge 101 is inserted, the positioning portion 122*a* and the rotation stopper portion 123*a* of the cartridge 101 are moved while being guided by the cartridge guides 114*a* and 115*a* of the apparatus main body A.

The pressing lever 125*a* is provided in an area (hereinafter, referred to as outside the passing area) through which the cartridge 101 does not pass when the cartridge 101 is inserted into the apparatus main body A. Furthermore, in the position in which the door 110 is open, the restriction surface 131*a* and the rotation restricting boss 129*a* are in contact with each other and the intermediate member 127*a* is held in an area other than the passing area of the cartridge 101. Furthermore, in a state in which the cartridge 101 is inserted to the mount position inside the apparatus main body A, the positioning portion 122*a* and the rotation stopper portion 123*a* of the cartridge 101 are in contact with the abutment portion 120*a* and the restriction portion 121*a* of the apparatus main body A. Note that the mount position described herein is a position in which, with respect to the apparatus main body A, the position of the cartridge 101 is set and the rotation of the cartridge is restricted, and is a position in which image can be formed. When the door 110 is at an open position where the door 110 is not having any effect on the cartridge 101, the cartridge 101 do not abut against the abutment portion 120*a* due to its own weight and by being pressed by the transfer roller 107.

Figure 6:
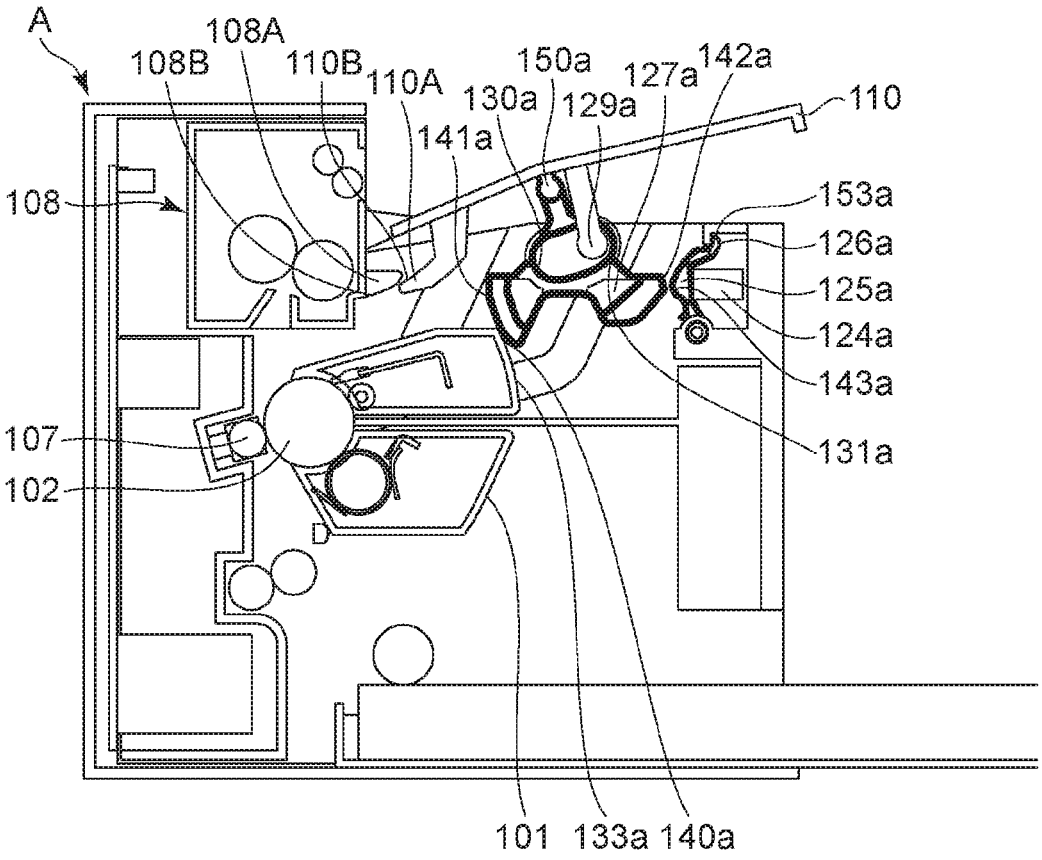
FIG. 6 is a cross-sectional view of the apparatus main body and the cartridge in a case in which the door is at a position between the open position and a closed position, according to the first exemplary embodiment.
Figure 7:
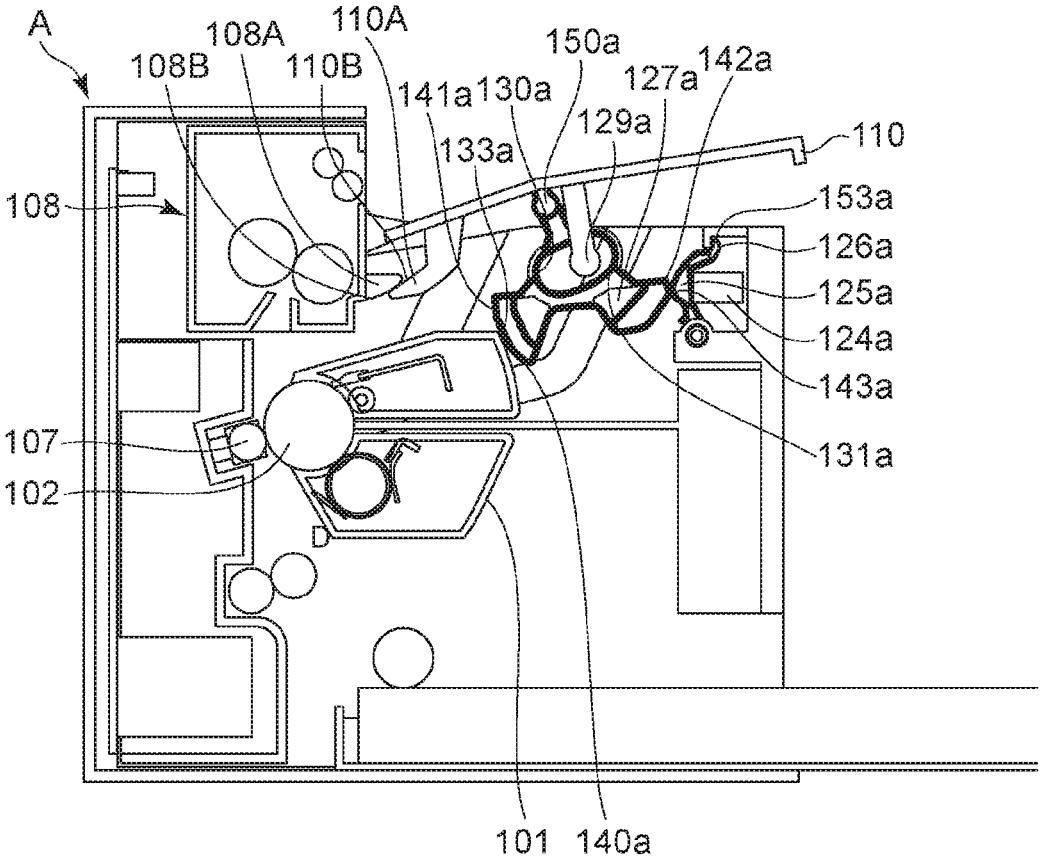
FIG. 7 is a cross-sectional view of the apparatus main body and the cartridge in a case in which the door is at a position between the open position and a closed position, according to the first exemplary embodiment.
Figure 8:
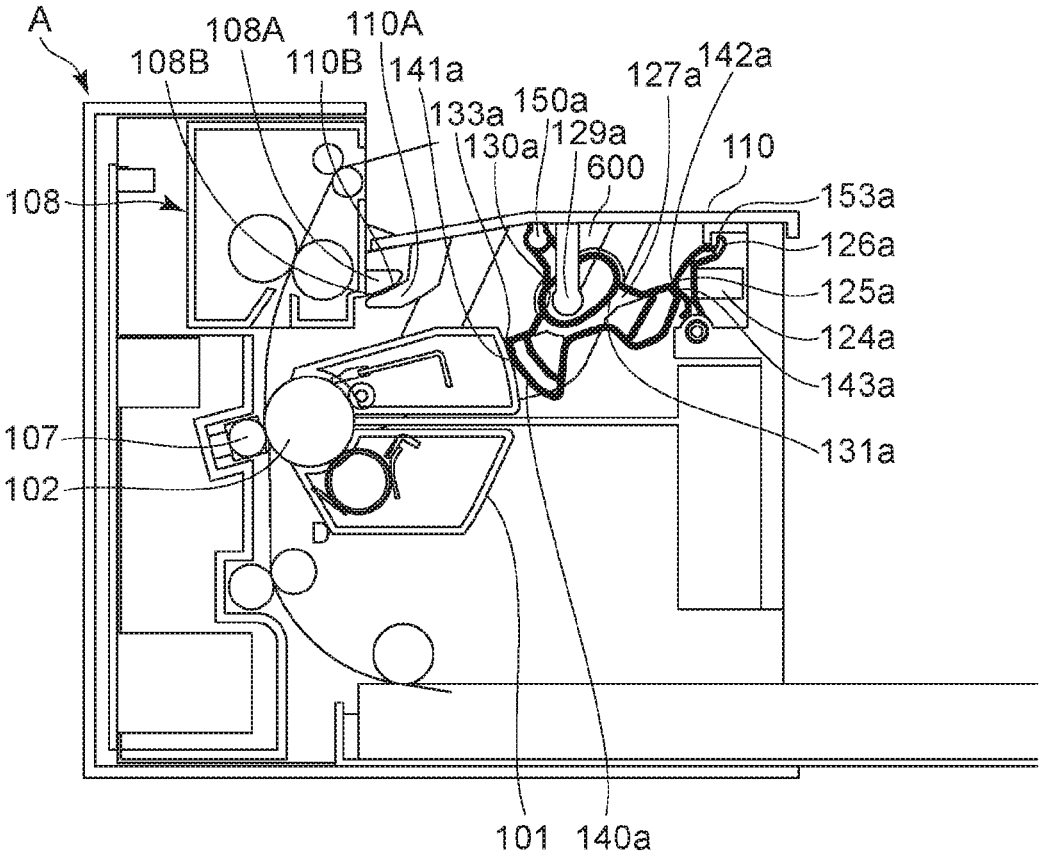
FIG. 8 is a cross-sectional view of the apparatus main body and the cartridge in a case in which the door is at the closed position, according to the first exemplary embodiment.

Referring to FIGS. 5 to 8, a description on how the cartridge 101 is moved to and held at the apparatus position while the door 110 is rotated from the open position to the closed position with respect to the apparatus main body A will be described. The door 110 in FIG. 5 is at a position (a first position) in which the opening portion 600, which allows insertion of the cartridge 101, is open. The door 110 in FIG. 8 is in a position (a second position) in which the opening portion 600 is closed. Note that while only a configuration of one end side (the drive side) of the photosensitive drum 102 in the longitudinal direction is described, a configuration of the other end side (the non-drive side) in the longitudinal direction is the same. In the course of rotating the door 110 from the open position (FIG. 5) to the closed position (FIG. 8), as illustrated in FIG. 6, a guide surface 140*a* of the intermediate member 127*a* and a contact surface 133*a* formed on the C-container 101*a* of the cartridge 101 come in contact with each other. From the above state, when the door 110 is rotated further, in the intermediate member 127*a*, the guide surface 140*a* and the contact surface 133*a* of the cartridge 101 are in contact with each other, accordingly, the restriction surface 131*a* of the intermediate member 127*a* and the rotation restricting boss 129*a* of the door 110 are brought to a noncontact state. When the door 110 is rotated further, a pressed surface 142*a* of the intermediate member 127*a* and a pressing surface 143*a* of the pressing lever come in contact with each other (FIG. 7). From the above state, when the door 110 is rotated further, the following happens. A distance between a pressing surface 141*a* that is a surface of the intermediate member 127*a* pressing against the cartridge 101 and the pressed surface 142*a* is configured to be larger than a distance between the contact surface 133*a* of the cartridge 101 and the pressing surface 143*a* of the pressing lever 125*a*. Furthermore, when the positioning portion 122*a* of the cartridge 101 moves to a position that comes in contact with the abutment portion 120*a* of the apparatus main body A, the intermediate member 127*a* in contact with the cartridge 101 and countering the spring force of the pressing spring 124*a* rotates the pressing lever 125*a*. As a result, the temporarily holding portion 126*a* of the pressing lever 125*a* is brought to a noncontact state with respect to the temporarily held portion 153*a* of the apparatus main body A, and the pressing spring 124*a* is in a state in which the pressing force is transmitted to the cartridge 101 through the intermediate member 127*a*. In other words, the intermediate member 127*a* is held between the pressing surface 143*a* of the pressing lever 125*a* and the contact surface 133*a* of the cartridge 101. As described above, the door 110 receives, through the guide surface 140*a* of the intermediate member 127*a* and the pressed surface 142*a* of the intermediate member 127*a*, force (counterforce) in a direction opposite to the direction in which the door 110 moves when moved to the closed position from the open position. In other words, the door 110 countering the counterforce of the pressing force of the pressing spring 124*a* rotates from the open position to the closed position. There are cases in which the door 110 is deformed when the door 110 receives the counterforce from the cartridge 101.

Using the comparative example of the present embodiment illustrated in FIG. 11, next, the mechanism in which a deformation occurs in the door will be described in detail. The apparatus main body A of the comparative example is not provided with the engaging portion of the door and the engaged portion that is in a portion of the apparatus main body A other than the door, which are features of the present exemplary embodiment. The configuration of the apparatus main body A other than the above is the same as that of the present exemplary embodiment. Furthermore, the configuration of the cartridge 101 of the comparative example is the same as that of the present exemplary embodiment.

Figure 11:
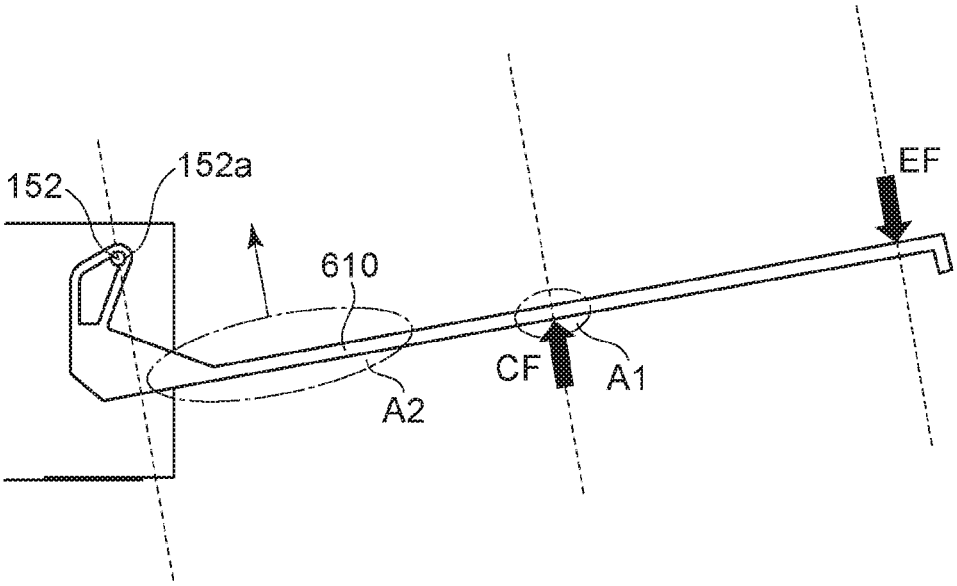
FIG. 11 is a cross-sectional view of a door of a comparative example of the first exemplary embodiment.

An door 610 of the comparative example in FIG. 11 receiving external force EF from the user in a direction extending from the open position towards the closed position rotates about a rotation center 152. In the above, an area A1 of the door 610 receives counterforce CF described above from the cartridge 101. Since the external force EF is applied to one end side of the door 610, an area A2 (an area between the rotation center 152 of the door 110 and the area A1) which is the other end side of the door 610 is deformed so as to be lifted in the direction of the counterforce CF (the direction of the arrow) with the area A1 as a fulcrum. In order to suppress such a deformation of the door 610, a measure such as increasing the rigidity of the door 610 or providing a plurality of detection sensors that detect the opening and closing of the door 610 can be conceived. However, when such a measure is implemented, problems will occur, such as an increase in cost and an increase in the size of the main body.

Figure 9A:
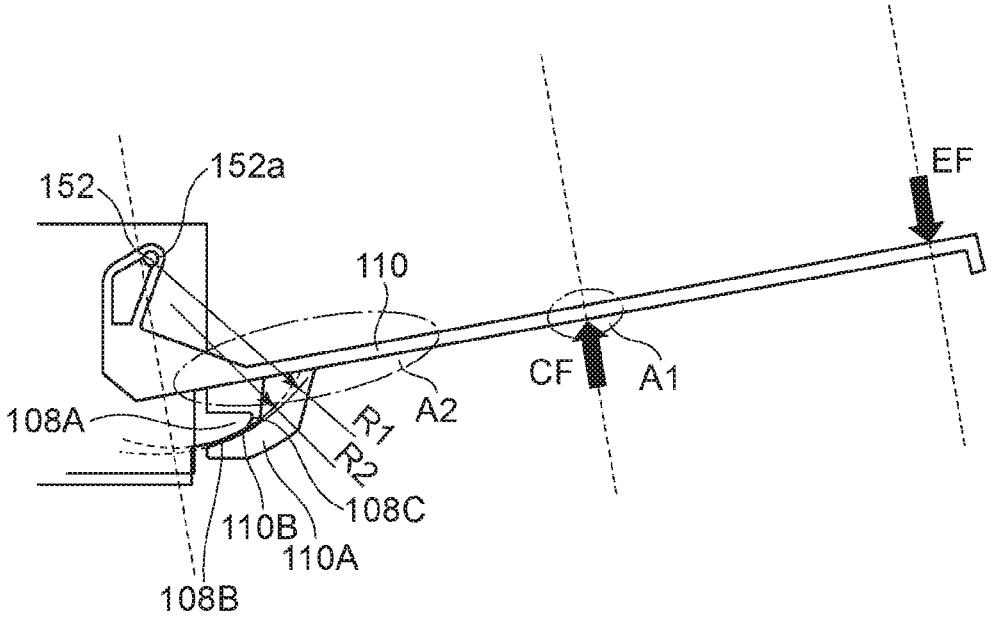
FIG. 9A is a cross-sectional view of the door according to the first exemplary embodiment.
Figure 9B:
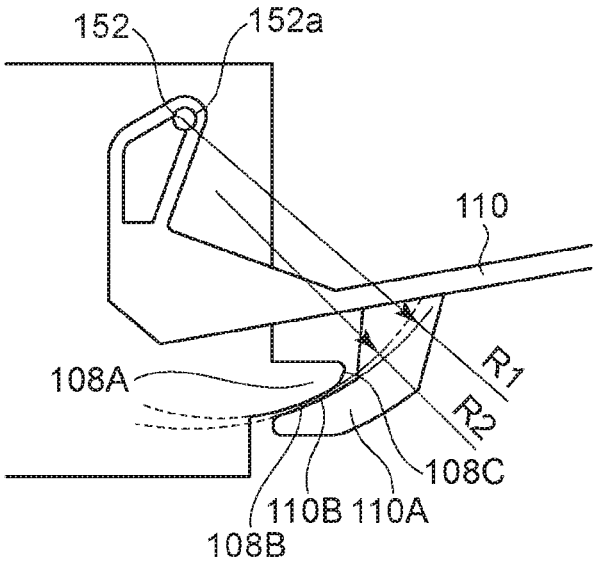
FIG. 9B is an enlarged cross-sectional view near a rotation center of the door according to the first exemplary embodiment.

A feature configuration of the present exemplary embodiment to suppress the deformation of the door 610 described above will be described. FIG. 9A is a cross-sectional view of the door 110 according to the present exemplary embodiment. FIG. 9B is an enlarged view of the vicinity of the rotation center 152 of the door 110.

An engaging portion 110A is provided in the door 110 of the present exemplary embodiment. Furthermore, an engaged portion 108A that engages with the engaging portion 110A is provided in the fixing unit 108 of the apparatus main body A. The engaging portion 110A and the engaged portion 108A are provided at portions separate from the portion (the door rotating shafts 152*a* and 152*b*, the bearings 151*a* and 151*b*) configuring the rotation center 152. Note that not limited to the fixing unit 108, the engaged portion 108A can be provided in any portion other than the door 110 of the apparatus main body A. The engaging portion 110A and the engaged portion 108A are provided in the drive side and the non-drive side, respectively, of the apparatus main body A. The engaging portion 110A includes, on the rotation center 152 side of the door 110, an arc-shaped engaging surface 110B formed about the rotation center 152 of the door 110. The engaged portion 108A is a surface opposing the engaging surface 110B, has a radius R2 that is smaller than a radius R1 of the engaging surface 110B of the door 110, and includes an arc-shaped engaged surface 108B extending along the engaging surface 110B. A guide surface 108C that continues smoothly from the engaged surface 108B and that guides the engaging portion 110A of the door 110 is provided in the engaged portion 108A.

A change in the state of the engagement between the engaging portion 110A of the door 110 and the engaged portion 108A while the door 110 is moved from the open position to the closed position will be described.

When the door 110 is at the open position (FIG. 5), the engaging surface 110B and the engaged surface 108B do not overlap (engaged with) each other in the rotation direction of the door 110. When the door 110 rotates from the open position towards the closed position, the engaging surface 110B approaches the engaged surface 108B. When the intermediate member 127*a* of the door 110 moves between and comes into contact with the contact surface 133*a* of the cartridge 101 and the pressing surface 143*a* of the pressing lever 125*a*, the door 110 starts to receive the counterforce CF through the intermediate member 127*a* (FIG. 7). The reactive force CF is the force exerted on the area A1 of the door 110 illustrated in FIG. 9A and is the force exerted in a direction opposite to the direction in which the door 110 is closed. Before or at the same time the door 110 receives the counterforce, the engaging surface 110B of the door 110 starts to overlap (engage with) the engaged surface 108B in the rotation direction of the door 110 (FIGS. 6 and 7). The engaging surface 110B overlaps with the engaged surface 108B so as to be positioned farther away from the engaged surface 108B with respect to the rotation center 152 of the door 110. As illustrated in FIG. 9A, when the counterforce CF is received in the area A1 of the door 110, the engaging surface 110B of the door 110 is engaged with (in contact with) the engaged surface 108B provided in the apparatus main body A. As a result, the deformation in the area A2 of the door 110 caused by being lifted in the direction of the counterforce can be suppressed.

Furthermore, the engaged surface 108B is provided in the area outside of the area where the engaging surface 110B passes while rotating together with the door 110. Furthermore, the engaging surface 110B of the door 110 is formed in an arc shape that is concentric to the rotation center of the door 110. Accordingly, force that prevents the door 110 from rotating from the open position to the closed position is only frictional force between the engaging surface 110B and the engaged surface 108B. As a result, an effect can be obtained in which the force that prevents the door 110 to rotate can be suppressed to the smallest.

With the above, the present exemplary embodiment can suppress the deformation of the door caused by the counterforce the door receives from the cartridge.

Second Exemplary Embodiment

In the present exemplary embodiment, only the portions that are different from the first exemplary embodiment will described and description of the portions that are the same will be omitted.

Figure 10:
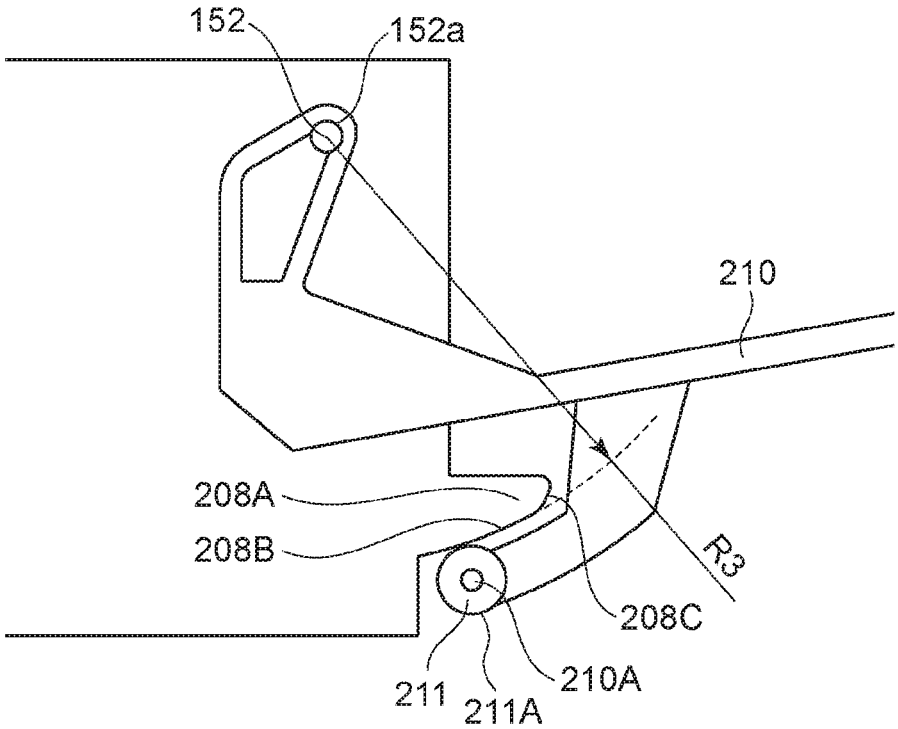
FIG. 10 is an enlarged cross-sectional view near a rotation center of a door according to a second exemplary embodiment.

As illustrated in FIG. 10, an door 210 includes a rotatable engaging member (a rotating member) 211 independent of the door 210. The engaging member 211 is attached rotatably about a center of a shaft portion 210A provided on the door 210. An outer peripheral surface of the engaging member 211 is an engaging surface 211A. Furthermore, an engaged portion 208A is provided in a fixing unit 208 of the apparatus main body A. The engaged portion 208A includes an engaged surface 208B that is formed having a circular arc configuration R3 that is concentric to the rotation center 152 of the door 110. Furthermore, a guide surface 208C smoothly continuing from the engaged surface 208B is formed on the engaged portion 208A.

When the door 210 starts to receive, from the cartridge 101 through the intermediate member 127*a*, counterforce in a direction opposite to the direction in which the door 210 rotates when rotated from the open position to the closed position, the engaging member 211 of the door 210 starts to overlap the engaged portion 208A in the rotation direction of the door 210. Furthermore, the engaging surface 211A of the engaging member 211 and the engaged surface 208B come in contact with each other; accordingly, the deformation of the door 210 can be suppressed.

While the engaging surface 211A and the engaged surface 208B are in contact with each other, in the present exemplary embodiment, the door 210 can move in the rotation direction in a smoother manner compared to the first exemplary embodiment. The above is because since the engaging member 211 including the engaging surface 211A is a separate member rotatable with respect to the door 210, the frictional force acting between the engaging surface 211A and the engaged surface 208B is small.

With the above, the present exemplary embodiment can suppress the deformation of the door caused by the counterforce the door receives from the cartridge.

Note that in the present exemplary embodiment, a configuration in which the engaging portion on the door side is a separate member rotatable with respect to the door is described; however, the engaged portion side may be a separate rotatable member.

Furthermore, in the first and second exemplary embodiments, the apparatus main body has been described in which the intermediate member is proved on the door, and the pressing force is applied to the door through the intermediate member from the pressing portion provided in a portion of the apparatus main body other than the door. However, the present disclosure can be applied to configurations other than the exemplary embodiments and to any configuration in which the cartridge is pressed through the door. For example, the present disclosure can be applied to a configuration in which there is no intermediate member, and a pressing portion is provided in the door, and in which the cartridge is pressed by the pressing member when the door is closed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-209486 filed Oct. 30, 2017, which is hereby incorporated by reference herein in its entirety.

What is claimed is:

1. An image forming apparatus comprising:

a cartridge including a rotating member that carries a toner, and a positioning portion; and an apparatus main body to which the cartridge can be detachably attached in an attaching direction, the apparatus main body including, an opening portion through which the cartridge passes when being attached to the apparatus main body, an opening and closing member that is rotatable about a rotational axis extending in a direction perpendicular to the attaching direction, the opening and closing member being rotatable between a first position where the opening and closing member does not cover the opening portion and a second position where the opening and closing member covers the opening portion, the opening and closing member including an engaging portion, an engaged portion that is configured not to become engaged with the engaging portion when the opening and closing member is at the first position and that is configured to engage with the engaging portion while the opening and closing member moves from the first position to the second position, an abutment portion that, by abutting against the positioning portion of the cartridge, determines a position of the cartridge with respect to the apparatus main body in the attaching direction when the cartridge is attached to the apparatus main body, and a pushing member attached to the opening and closing member and configured to push the cartridge toward the abutment portion while the opening and closing member is rotating toward the second position, wherein when viewed in a direction of the rotational axis, the engaging portion is provided in an area of the opening and closing member between the rotational axis and an attached portion thereof to which the pushing member is attached, and is configured to be on a side opposite to the rotational axis across the engaged portion when the engaging portion engages with the engaged portion.

2. The image forming apparatus according to claim 1, wherein the engaged portion is provided in an area outside an area through which the engaging portion passes when the opening and closing member rotates from the first position to the second position.

3. The image forming apparatus according to claim 1, wherein when viewed in the direction of the rotational axis, the engaging portion of the opening and closing member includes an arc-shaped engaging surface centered at the rotational axis, and the engaged portion of the apparatus main body includes an arc-shaped engaged surface extending along the engaging surface, and wherein while the opening and closing member is rotating toward the second position, the engaging surface is positioned farther away from the rotational axis than the engaged surface when viewed in the direction of the rotational axis, and the engaging surface and the engaged surface overlap each other when viewed in a direction intersecting the rotational axis.

4. The image forming apparatus according to claim 3, wherein a radius of an arc of the engaged surface is smaller than a radius of an arc of the engaging surface.

5. The image forming apparatus according to claim 1, wherein when viewed in the direction intersecting the rotational axis, the engaging portion and the engaged portion overlap each other when the opening and closing member is at the second position.

6. The image forming apparatus according to claim 1, wherein the apparatus main body includes a pressing portion that applies pressing force to the cartridge in a direction abutting the positioning portion of the cartridge against the abutment portion, wherein in the attaching direction, the pressing portion is provided opposite to the abutment portion across the cartridge, and wherein the pushing member is a sandwiched unit that is sandwiched between the cartridge and the pressing portion when the opening and closing member is at the second position, the pressing portion applying the pressing force to the cartridge through the sandwiched unit.

7. The image forming apparatus according to claim 6, wherein the sandwiched unit is movably attached to the opening and closing member.

8. The image forming apparatus according to claim 6, where the rotating member is an image carrying member configured to carry a toner image, wherein the cartridge includes a first unit that includes the image carrying member and the positioning portion, and a second unit that includes a developing member that develops the toner image by supplying toner to the image carrying member, and wherein the sandwiched unit is configured so as to be pinched between the first unit and the pressing portion.

9. The image forming apparatus according to claim 6, wherein the sandwiched unit includes a restriction portion that restricts a movable area of the sandwiched unit with respect to the opening and closing member.

10. The image forming apparatus according to claim 1, wherein when viewed in the direction of the rotational axis, the engaging portion is provided in the area of the opening and closing member that is closer to the rotational axis than the pushing member.

11. An image forming apparatus comprising:

a cartridge including a rotating member that carries a toner, and a positioning portion; and an apparatus main body to which the cartridge can be detachably attached in an attaching direction, the apparatus main body including, an opening portion through which the cartridge passes when being attached to the apparatus main body, an opening and closing member that is rotatable about a rotational axis extending in a direction perpendicular to the attaching direction, the opening and closing member being rotatable between a first position where the opening and closing member does not cover the opening portion and a second position where the opening and closing member covers the opening portion, the opening and closing member including an engaging portion, an engaged portion that is configured not to become engaged with the engaging portion when the opening and closing member is at the first position and that is configured to engage with the engaging portion while the opening and closing member moves from the first position to the second position, an abutment portion that, by abutting against the positioning portion of the cartridge, determines a position of the cartridge with respect to the apparatus main body in the intersecting direction of the cartridge when the cartridge is attached to the apparatus main body, and a pushing portion provided on the opening and closing member and configured to push the cartridge toward the abutment portion, wherein when viewed in a direction of the rotational axis, the engaging portion is provided in an area of the opening and closing member between the rotational axis and a portion thereof receiving counterforce from the cartridge through the pushing portion, and is configured to be on a side opposite to the rotational axis across the engaged portion when the engaging portion engages with the engaged portion.

12. The image forming apparatus according to claim 11, wherein the engaged portion is provided in an area outside an area through which the engaging portion passes when the opening and closing member rotates from the first position to the second position.

13. The image forming apparatus according to claim 11, wherein when viewed in the direction of the rotational axis, the engaging portion of the opening and closing member includes an arc-shaped engaging surface centered at the rotational axis, and the engaged portion of the apparatus main body includes an arc-shaped engaged surface extending along the engaging surface, and wherein while the opening and closing member is rotating toward the second position, the engaging surface is positioned farther away from the rotational axis than the engaged surface when viewed in the direction of the rotational axis, and the engaging surface and the engaged surface overlap each other when viewed in a direction intersecting the rotational axis.

14. The image forming apparatus according to claim 13, wherein a radius of an arc of the engaged surface is smaller than a radius of an arc of the engaging surface.

15. The image forming apparatus according to claim 11, wherein when viewed in the direction intersecting the rotational axis, the engaging portion of the opening and closing member and the engaged portion overlap each other when the opening and closing member is at the second position.

16. The image forming apparatus according to claim 11, wherein the apparatus main body includes a pressing portion that applies pressing force to the cartridge in a direction abutting the positioning portion of the cartridge against the abutment portion, wherein in the attaching direction, the pressing portion is provided opposite to the abutment portion across the cartridge, and wherein the pushing portion is a sandwiched unit that is sandwiched between the cartridge and the pressing portion when the opening and closing member is at the second position, the pressing portion applying the pressing force to the cartridge through the sandwiched unit.

17. The image forming apparatus according to claim 16, wherein the sandwiched unit is movably attached to the opening and closing member.

18. The image forming apparatus according to claim 16, where the rotating member is an image carrying member configured to carry a toner image, wherein the cartridge includes a first unit that includes the image carrying member and the positioning portion, and a second unit that includes a developing member that develops the toner image by supplying toner to the image carrying member, and wherein the sandwiched unit is configured so as to be pinched between the first unit and the pressing portion.

19. The image forming apparatus according to claim 16, wherein the sandwiched unit includes a restriction portion that restricts a movable area of the sandwiched unit with respect to the opening and closing member.

20. The image forming apparatus according to claim 11, wherein when viewed in the direction of the rotational axis, the engaging portion is provided in the area of the opening and closing member that is closer to the rotational axis than the pushing portion.

* * * * *